US005184449A

United States Patent [19]

Hannen

[11] Patent Number: 5,184,449

[45] Date of Patent: Feb. 9, 1993

[54] METHOD OF AND APPARATUS FOR THE WRAPPING OF PALLETIZED UNITS

[75] Inventor: Reiner W. Hannen, Pfalzdorf, Fed. Rep. of Germany

[73] Assignee: Develog, Reiner Hannen & Cie, Courtelary, Switzerland

[21] Appl. No.: 743,046

[22] Filed: Aug. 9, 1991

[30] Foreign Application Priority Data

Aug. 9, 1990 [DE] Fed. Rep. of Germany ..... 4025201

[51] Int. Cl.[5] ..... B65B 11/58; B65B 13/12

[52] U.S. Cl. ..... 53/399; 53/176; 53/441; 53/449; 53/556; 53/588

[58] Field of Search ..... 53/176, 201, 210, 211, 53/399, 441, 449, 465, 556, 587, 588

[56] References Cited

U.S. PATENT DOCUMENTS 2,908,122 10/1959 Allen ..... 53/399
4,079,565 3/1978 Lancaster et al. ..... 53/441 X
4,409,776 10/1983 Usui ..... 53/587 X
4,500,001 2/1985 Daniels ..... 53/399 X
4,712,354 12/1987 Lancaster et al. ..... 53/588 X
4,730,436 3/1988 Angelino ..... 53/588 X
4,993,209 2/1991 Haloila ..... 53/588 X

FOREIGN PATENT DOCUMENTS 282020 11/1990 Japan ..... 53/587

*Primary Examiner*—John Sipos
*Assistant Examiner*—Linda B. Johnson
*Attorney, Agent, or Firm*—Herbert Dubno

[57] ABSTRACT

A pallet unit consisting of a stack of articles on a pallet is wrapped both vertically and horizontally with a foil band by orbiting a wrapping satellite in a vertical plane while the unit is supported on a pair of support arms which pass through the orbit for vertical wrapping and the orbit is swung into a horizontal position and raised and lowered for horizontal wrapping of the unit. The vertical wrapping is only effected along two vertical sides of the stack and the foil wrap passes between the skids of the pallet.

15 Claims, 3 Drawing Sheets

METHOD OF AND APPARATUS FOR THE WRAPPING OF PALLETIZED UNITS

CROSS REFERENCE TO RELATED APPLICATION

This application is related to my copending application Ser. No. 07/712,156 filed Jun. 6, 1991.

FIELD OF THE INVENTION

My present invention relates to a method of wrapping a stack of articles on a pallet, hereinafter referred to as a palletized unit, with a foil band. The invention also relates to an apparatus for carrying out this method and, in particular, to an apparatus which has a frame upon which at least one satellite can orbit as driven by a motor and which holds a supply of the foil band and, under tension resulting from the braking of the supply of the foil, can wind that foil around the palletizec unit. The principles of wrapping a foil around an article such as a palletized unit with braking of the foil supplied, are discussed in the above mentioned copending application.

BACKGROUND OF THE INVENTION

Systems wherein a stack of articles or goods upon a pallet can be packaged by wrapping a foil around therein substantially horizontally in a generally spiral pattern or in annular sections so that the foil will extend around the vertical sides of the palletized unit are, of course, known. The foil bands which are used are generally so called stretch foils which are already prestretched and thus have been strengthened by a stretching process.

The apparatus for applying such foil wraps can comprise a substantially toroidal frame which is vertically displaceable and carries a support ring which can extend in a horizontal plane. A rotating ring can be driven about a vertical axis on the support ring and can carry a satellite provided with means for receiving a roll of the foil band and a means for braking the delivery of the foil from that roll.

For the winding operation, the support frame is initially lowered to its bottom-most position and a free end of the foil band is applied to the stack. The satellite is then caused to orbit the stack as the support frame is gradually raised so that, as the satellite orbits the stack in a generally helical pattern, the foil band will be wrapped around the vertical sides of the stack and, because the delivery of the foil is braked, an additional stretch will be applied to the foil which thus engages the stack of articles under tension.

To avoid shifting of the articles of the stack it is also known to provide a fixing plate on the apparatus which can be lowered onto the top of the stack to hold the articles in place as the foil is wrapped therearound.

Furthermore, a cover sheet applying device can be provided which can overhang the top of the palletized unit in an outrigger fashion to apply a foil sheet to the stack which can be held in place by the last turns of the foil band.

A drawback of this wrapping method is that it does not always ensure a good connection between the stack of articles and the pallet. Furthermore, the wrapping system does not provide a residual vertical force on the stack which can assist in holding the articles against one another and against the pallet.

It is also known to wrap palletized units with substantially vertical turns of foil which pass over the head and under the foot of the unit and also, therefore, are wound around the vertical sides thereof. After winding the palletized unit in the vertical direction along two vertical sides, the unit is rotated through 90° about its vertical axis and the foil wrap is then applied in a direction crosswise to the first direction, also in the vertical sense so that all six sides of the unit will be wrapped.

In this method, a vertical stress is applied to the stack of articles to hold the stack against the pallet and the articles of the stack against one another. However, in this case, the positioning of the articles in the horizontal direction is not always satisfactory. Indeed, horizontal shifting of the articles frequently cannot be avoided.

Furthermore, this latter method results in winding of the foil wrap around the skids of the pallet so that frequently the packaged unit cannot be transported by means of a manually operated lift or, for that matter, a mechanically driven forklift. In transportation of the palletized wrapped unit there is always the danger that the foil segments in the region of the skids will be damaged or ruptured and hence the connection of the stack of articles to the pallet will be weakened or broken.

OBJECTS OF THE INVENTION

It is, therefore, the principal object of the present invention to provide a method of packaging a palletized unit of the type described whereby the aforementioned drawbacks are eliminated.

A more specific object of the invention is to provide an improved method of packaging a palletized unit with a foil wrap whereby horizontal shifting of the articles or goods of the stack is precluded in a highly effective manner and simultaneously a good connection is ensured between the stack and the pallet without interfering with the ability to transport the unit to lift or otherwise handle the unit utilizing conventional pallet handling equipment, such as a forklift truck or a manual palletized-goods transport.

Another object of the invention is to provide an improved apparatus for wrapping a palletized unit so that the resulting package is more reliable and less prone to damage in the transporting of the package unit.

SUMMARY OF THE INVENTION

These objects and others which will become more readily apparent hereinafter are attained, in accordance with the invention, in a method of packaging a stack of articles on a pallet forming a palletized unit, the palletized unit comprising a top formed by the stack, vertical sides formed by the stack, and a bottom adapted to support the unit, the pallet having skids along the bottom extending parallel to a first pair of the sides and being accessible to a fork for lifting and moving the unit at a second pair of the sides, the method comprising the steps of:

(a) wrapping the unit substantially horizontally by winding a foil band in a plurality of generally horizontal turns around the sides; and (b) wrapping the unit substantially vertically by winding a foil band around the unit in a plurality of generally vertical turns from the top to the bottom and along one of the pairs of the sides.

This method, in which the palletized unit is wrapped substantially horizontally around all of its vertical sides and is wrapped substantially vertically over the head and foot or top and bottom of the unit and over at least one pair of opposite vertical sides has been found to provide surprising advantages over the conventional methods described. On the one hand, it ensures a reliable connection between the pallet and the stack of articles and goods while, on the other hand, it ensures that a lateral or horizontal slip of individual layers of the articles will be avoided.

The improved package also is completely protected from the weather without the need for a special device for covering the stack. Since the vertical wrap can be applied effectively only along two sides of the package essentially parallel to the skids, local damage to sections of the foil can be avoided or, at the very least, damage to the foil in transporting the unit can be greatly reduced by comparison to earlier methods. One of the great advantages of the system of the invention is that the horizontal wrap cannot be effected by the engagement of a fork or other lifter with the bottom of the unit and thus at least the horizontal wrap will remain intact even though there might be some damage to the vertical wrap from the handling of the pallet unit.

An advantage of the invention is, moreover, that the changes of the sequence in which the steps of the method can be carried out, can be selected to satisfy the particular needs. For example, if the connection between the stack and the pallet and thus the vertical wrap is most important for a particular palletized unit, I initially will apply the horizontal wrap and thereafter the vertical wrap. In this manner, the horizontal wrap serves to presecure the stack in place so that, in application of the vertical wrap, a significantly higher foil tension can be applied.

When, however, for a particular packaged unit it is more important to secure the layers against shifting in the horizontal sense, I prefer to apply the vertical wrap first to presecure the stack and the pallet and then to wrap the unit horizontally so that, for the horizontal wrap a higher pretension can be applied to the foil than is the case, for example, in conventional methods of horizontal wrapping. The method of the invention, therefore, increases the possibility of combining the advantages of the two wrapping steps.

According to a feature of the invention, the pallet unit is wrapped exclusively in parallel to the skids of the pallet in the vertical wrapping step. In this manner, the foil band segments running along the bottom of the unit can be disposed exclusively between the skids although the vertical turns can spread out outwardly to cover the entire top of the stack. Thus a space is maintained between the skids to enable the wrapped palletized unit to be handled with a manual carrier or transporter in a particularly advantageous manner.

Since the foil band in the region of the foot of the palletized unit is disposed exclusively between the skids, there is less danger of damage to the vertical wrap and hence any likelihood toward loosening of the connection between the stack and the pallet can be reduced.

For this vertical wrapping step, the pallet unit can be moved horizontally and transverse to the direction of elongation of the skids so that the foil band can pass, in the region of the foot of the unit, between the skids of the pallet while over the remaining portions can spread uniformly over the stack. In this manner, the head of the unit can be completely covered and thus the vertical prestress applied by the stretched vertical wrap can be distributed over the entire area of the top of the unit.

In addition, this wrapping technique applies diagonally effective prestress to the wrapped package affording additional security against slipping of the load upon the pallet.

While the vertical horizontal wrapping can be effected in two different devices provided respectively for the vertical and horizontal wrapping and with transfer of the partly wrapped package from one device or apparatus to the other, I can provide a single apparatus especially intended to carry out the method of the invention with its two distinct wrapping modes.

According to the invention the support for the satellite or satellites is swingable into a horizontal plane and into a vertical plane, selectively, so that the orbit of the satellite can lie in either plane. The apparatus thus permits selectively a vertical and a horizontal wrapping of the pallet units by simply swinging the orbit or circulatory travel path of the satellite or satellites through 90° from one position to the other. In this case, any need to transport the unit between two wrapping stations is avoided.

With the apparatus of the invention, the satellite or the satellites are preferably mounted to orbit on a support frame which is swingably mounted about a horizontal axis on one side of a support upon which that frame can be vertically raised and lowered. It has been found to be especially advantageous to provide the satellite or satellites on a rotating ring which is rotatably mounted on the support ring. This configuration has been found to simplify essentially the vertical wrapping of the pallet unit.

According to a further feature of the invention, the apparatus includes a carriage provided with a support arm which is cantilevered on the carriage and can engage the palletized unit for displacing same into position beneath the support ring and which can pass through the support ring and rotating ring of the satellite for the horizontal and vertical wrapping of the palletized unit, respectively. By corresponding back and forth movement of the carriage, moreover, I can ensure that as the band passes downwardly to the bottom of the palletized unit, the unit can be shifted to ensure that the band will pass only between the skids in the manner described previously. After the vertical wrapping of the unit, the carriage can be withdrawn, e.g. after the palletized unit has been deposited upon a transfer device capable of forwarding the palletized unit to a conveyor or the like.

The cantilevered support arm can be provided with a vertical spacing above the track for the carriage or the surface upon which the carriage is displaced, in the vertical position of the satellite orbit, to permit the satellite to travel with the support arm and the surface therebeneath. This greatly simplifies the configuration of the carriage and its path or guide surfaces.

According to a feature of the invention, the apparatus comprises a support table for the pallet unit which can be provided with means for shifting the pallet unit perpendicular to the plane of the satellite orbit in its vertical position. The transport means simplifies the placing of the pallet unit upon the support arm of the carriage. The support table can be vertically displaceable and can have a width significantly less than the free spacing between two support arms of the carriage.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
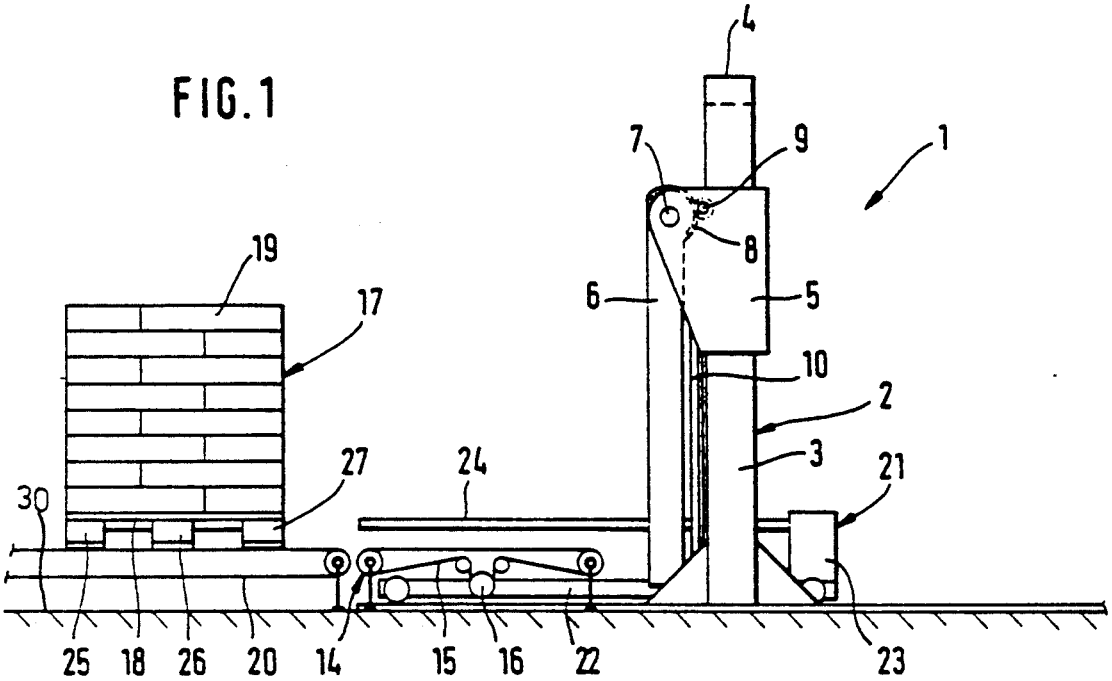
FIG. 1 is a diagrammatic vertical section of an apparatus according to the invention showing the palletized unit on a conveyor prior to being transferred to the support table for the cantilever arms of the apparatus.

The coiling apparatus 1 shown in the drawing comprises a portal-like frame member 2 having two uprights 3 and a cross-piece 4, only the front upright 3 being 5 visible in FIGS. 1–5. The frame or support 2 is fixed on the foundation or round 30 and constitutes a post as mentioned previously.

Figure 2:
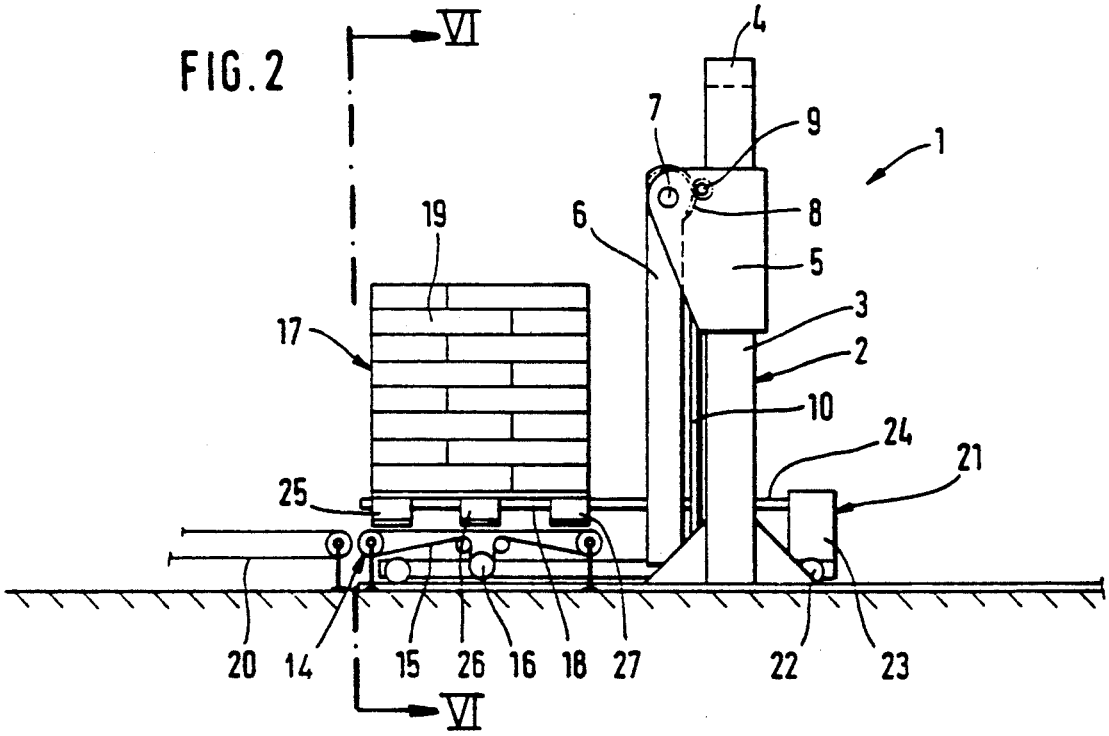
FIG. 2 is a similar view which illustrates the transfer to the cantilever arms.
Figure 3:
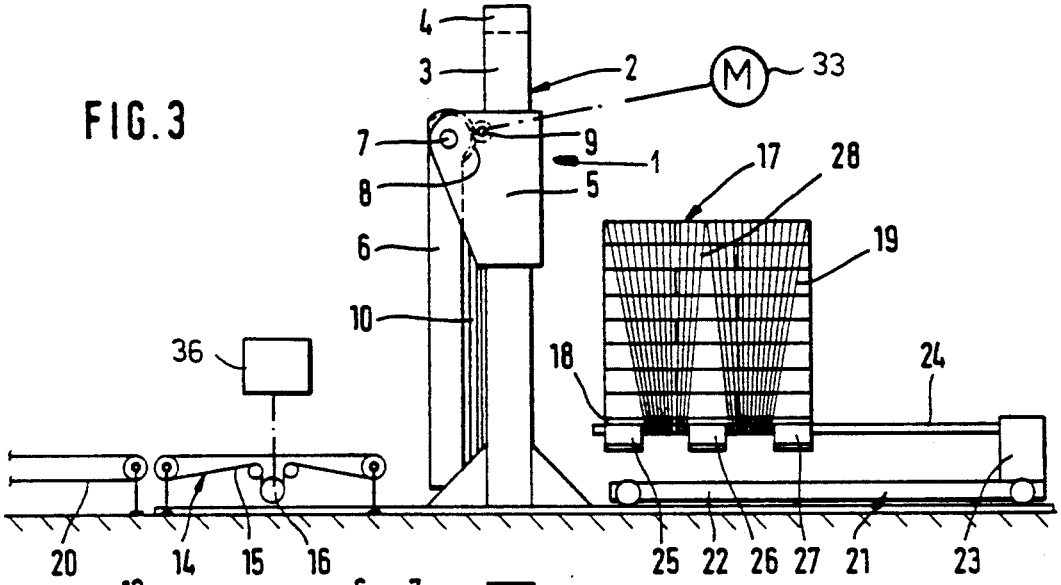
FIG. 3 shows the vertically wrapped package prior to swinging of the orbit of the rings into the horizontal position.
Figure 6:
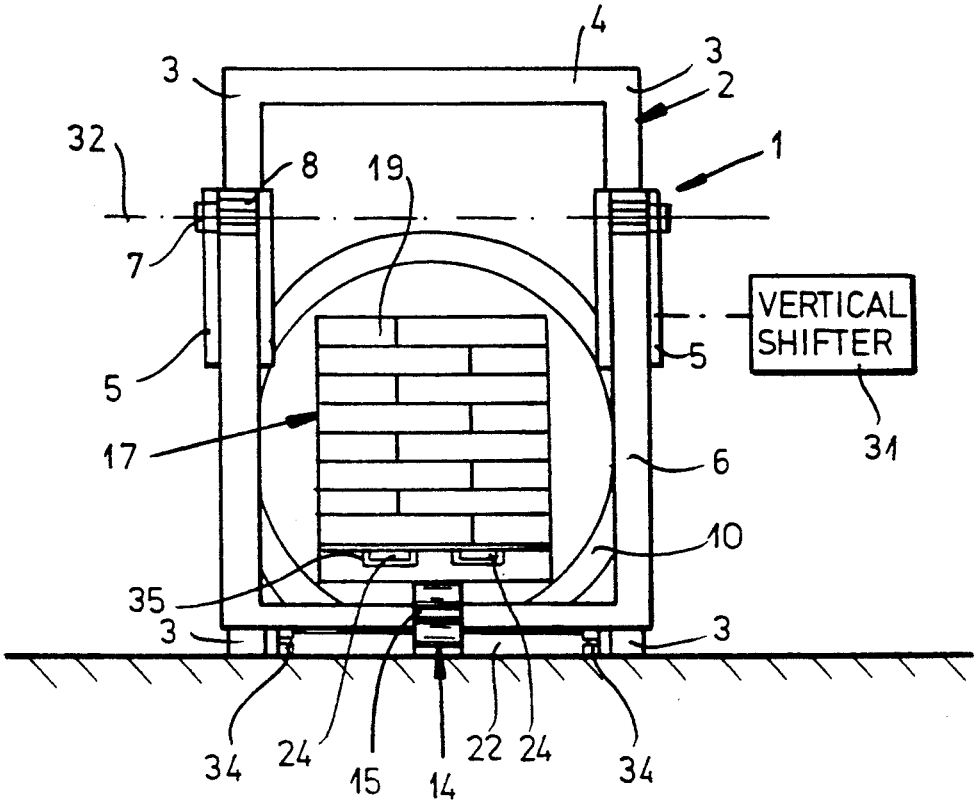
FIG. 6 is a view taken along line VI—VI of FIG. 2 omitting the satellite or satellites carrying the rolls of foil wrapping and provided with braking devices as described in the aforementioned copending application.

On each of the uprights 3, a respective slide 5 is vertically shiftable by a means represented at 31 in FIG. 6 and constituting a vertical shifter of the type conventional in wrapping mean capable of horizontally wrapping the palletized unit (see, for example, the aforementioned copending application). In the two slides, the two ends of a U-shaped support frame 6 are pivotally connected on respective pivots 7 defining a horizontal pivot axis 32. The free ends can be formed as gear segments 8, each of which meshes with a pinion 9 which can be driven by electric motors as represented diagrammatically at 33 in FIG. 3 to enable the support frame 6 to be swung from the vertical plane as shown in FIGS. 1–3 into the horizontal plane of FIGS. 4 and 5 and vice versa.

On the underside of the support frame 6 is suspended a circular support ring 10 which defines a track for a rotating ring 11 mounted therebelow. On the ring 11 at least one satellite 12 can be mounted and can carry a roll of the foil to be wound around the stack and a brake device, also represented at 12 utilizing, for example, the principles of the aforementioned application.

Opposite the coiling unit formed by the roller foil and its foil brake 12 on the ring 11 is a counterweight 13 to compensate for the mass of the coiling unit. Instead of the counterweight 13 a further satellite coiling unit can be provided so that the stack can be represented simultaneously with two foil bands.

Below the support frame 6 in the horizontal position therefore (see especially FIGS. 4 and 5) is a support table 14 (FIG. 6) equipped with a conveyor belt which can be displaced via a drive wheel 16. As can be seen from a comparison of FIGS. 1 and 2, a palletized unit 17, comprised of a pallet 18 and a stack 19 of articles on the pallet, can be delivered to the support table 14 from a conveyor unit 20 by driving the belts of this conveyor unit and the support table 14.

The coiling apparatus also comprises a carriage 21 which has a travelling undercarriage 22 and, at its rear end, a support frame 23 from an upper side of which project cantilevered support arms 24. The width of the carriage is such that it can pass between the uprights 3 of the portal frame 2 of the apparatus. The undercarriage 22 can travel via wheels on tracks 34 (see FIG. 6) inwardly of the posts 3.

The apparatus can effect a wrapping operation as follows:

Before the palletized unit 17 is advanced into the wrapping apparatus 1, the support frame 6 with its support ring 10 and rotating ring 11 is swung downwardly into its vertical orientation (FIG. 1).

The carriage 21 is then shifted to the left so that its cantilevered arms 24 above the undercarriage 22 pass over the support frame 6 while the undercarriage 22 passes below the support frame. The support frame 6 with its support ring 10 and rotatable ring 11 thus lie between the arms 24 and the undercarriage 22. The support table 14 thus lies in the plane of the conveyor 20 and below the plane of the arms 24. The pallet unit 17 is displaced onto the support table 14 so that the arms 24 can engage through holes or gaps 35 in the skids 25, 26, 27 of the pallet 18. The support table 14 is then lowered by means of a table lowering device represented only at 36 in FIG. 3 so that the pallet unit 17 comes to rest on the support arms 24.

Figure 7:
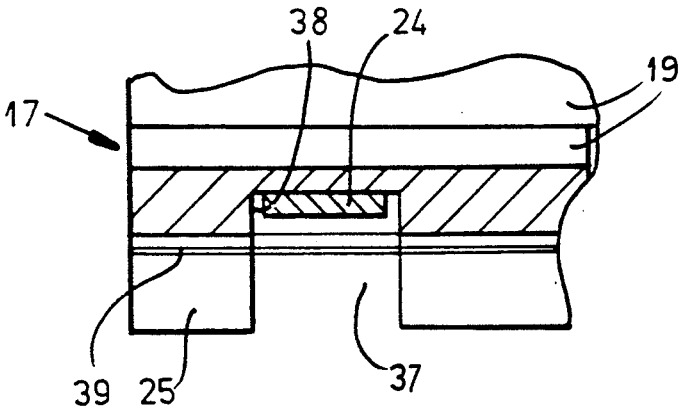
FIG. 7 is a cross section through one of the cantilevered arms and a portion of the pallet engaged thereby.

In FIG. 7, I show that the skids, for example, the skid 25, can be interrupted at 37 to accommodate the arms 24 and further that, between the skids, channels 38 can be provided in the underside of the pallet to be spanned by the turns of the foil band 39 wrapped around the bottom of the pallet as will be described.

When the pallet unit is seated on the support arms 24, the apparatus is in the position shown in FIG. 2.

From the satellite 12, an end of the foil band is affixed on the pallet unit 17 and the ring 11 is set in rotation so that the satellite 12 will orbit the pallet unit. As a consequence, the pallet unit 17 is vertically wrapped. With slow displacement of the carriage 12, in the view shown in FIG. 2 to the right, the foil band is applied in a helical or spiral pattern around the pallet unit 17.

The displacement of the carriage 21 is effected by an oscillating drive which, as the band is in position to undersling the unit, disposes the region between the skids 25, 26 and 27 in the path of the band so that the pallet 18 is vertically wrapped at its underside only between the pairs of skids 25 and 26, 26 and 27 respectively. The skids 25 to 27 remain free of the turns 39 of the foil passing around the bottom of the pallet on the upper surface of the pallet unit 17, however, the unit is so moved that the foil wrap is applied uniformly to completely cover the surface.

After the vertical wrapping is complete (FIG. 3), the pallet unit 17 is withdrawn by the carriage 21 to the right out of the plane of the ring 11.

Figure 4:
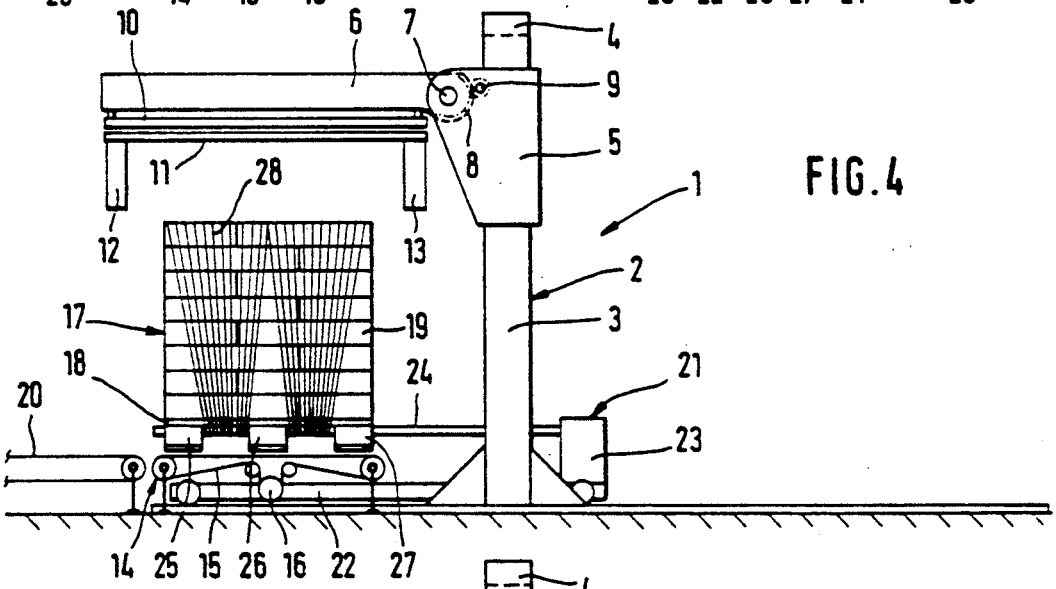
FIG. 4 is a similar view showing the position of the apparatus preparatory to the horizontal wrapping.
Figure 5:
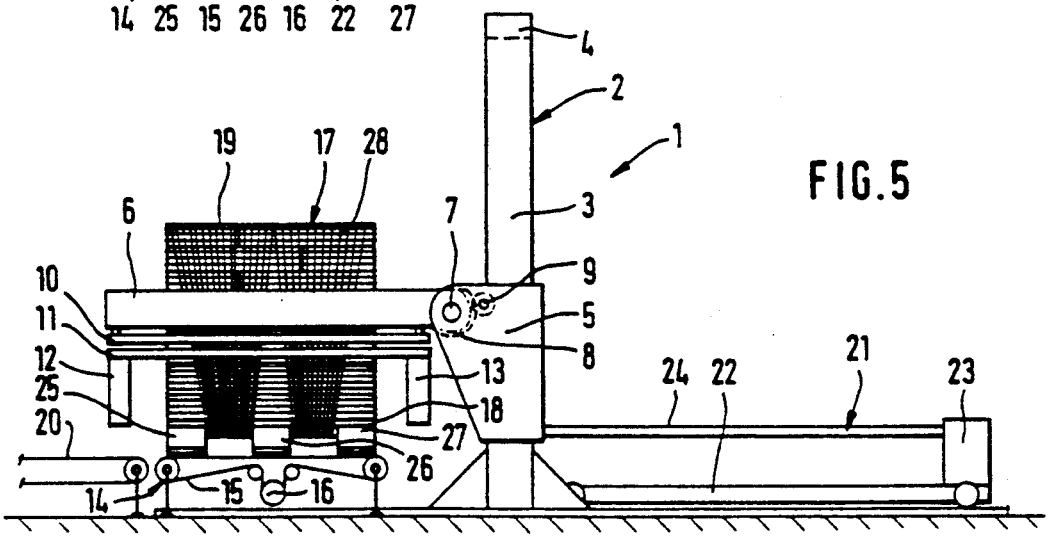
FIG. 5 shows the position of the unit during the horizontal wrapping.

The support frame 16 is then swung into the horizontal plane. Then the carriage 21 is shifted again to the left to place the partially wrapped unit 17 below the support 6, the ring 10 and the rotating ring 11 (FIG. 4). The support table 14 is lifted to accept the pallet unit 17, whereupon the arms 24 are retracted (FIG. 5) and coiling is commenced by rotation of the ring 10 and lowering of the assembly 6, 10, 11, 12. A helical wrap is applied horizontally beginning from the upper edge of the stack 19. The stack can be wrapped downwardly and then again upwardly as desired. After the horizontal wrapping is complete, the support frame 6 is raised until the pallet unit 17 can be displaced by the table 14 onto the conveyor 20 from which it can be transferred away from the apparatus. The carriage 21 is then returned to its original position (FIG. 1) and a new pallet unit can be wrapped.

I claim:

1. A method of packaging a stack of articles on a pallet forming a palletized unit, said palletized unit comprising a top formed by said stack, vertical sides formed by said stack, and a bottom adapted to support said unit, said pallet having skids along said bottom extending parallel to a first pair of said sides and being accessible to a fork for lifting and moving said unit at a second pair of said sides, said method comprising the steps of:

(a) lowering circumferentially around said stack from above said top of said stack a wrapping device having a vertical axis and supporting a foil band source and wrapping said unit substantially horizontally by winding a foil band from said source in a plurality of generally horizontal turns around said sides, and swinging said wrapping device into a position having a horizontal axis perpendicular to said vertical axis; and (b) passing said horizontally wrapped stack through said wrapping device and wrapping said unit substantially vertically by winding a foil band from said source around said unit including underneath said pallet between at least a pair of said skids in a plurality of generally vertical turns from said top to said bottom and along one of said pairs of said sides.

2. The method defined in claim 1 wherein, in step (b), said unit is wound exclusively parallel to said skids with the respective foil band upon the wrapping of said unit substantially vertically.

3. The method defined in claim 2 wherein, in the wrapping of said unit substantially vertically, the respective foil band is passed along said bottom substantially exclusively between said skids.

4. The method defined in claim 3 wherein, in step (b) said unit is shifted horizontally and transverse to said wrapping device to position said band between said skids in the region of said bottom and said unit is shifted as said band is wound around said top to uniformly distribute the head across the top in a fan-shape arrangement.

5. An apparatus for wrapping a stack of articles on a pallet which comprises:

an upright support whose length is defined by a vertical axis;

at least one frame on said support;

means for orbiting a satellite carrying and adapted to deliver a foil band for wrapping a palletized unit consisting of said stack and said pallet with said foil band and for orbiting said satellite on said frame around said unit;

means for swingably mounting said frame on said support for selective displacement of said frame between a horizontal plane perpendicular to said vertical axis wherein orbiting of said satellite wraps said unit horizontally parallel to said horizontal plane and a vertical plane wherein orbiting of said satellite wraps said unit vertically parallel to said vertical axis encompassing said palletized unit from a top of said stack to underneath said pallet; and means for passing said palletized unit through said frame while said frame is in said vertical plane.

6. The apparatus as defined in claim 5 wherein said frame is mounted on said support for vertical raising and lowering thereon.

7. The apparatus as defined in claim 5 wherein said frame is provided with a support ring and a rotating ring rotatable on said support ring and carrying said satellite.

8. The apparatus as defined in claim 5, further comprising a carriage provided with cantilevered support arms adapted to extend through said frame for supporting said unit when said frame is displaced in said vertical plane.

9. The apparatus as defined in claim 8 wherein said support arms are disposed at a distance above an undercarriage of said carriage enabling passage of said pallet between said support arms and said undercarriage.

10. The apparatus as defined in claim 5, further comprising a support table for receiving said unit and provided with means for shifting said unit perpendicular to said frame when said frame is displaced in said horizontal plane.

11. The apparatus defined in claim 5, further comprising a support table for receiving said unit and said support table being vertically shiftable relative to said frame in a direction along said vertical axis.

12. The apparatus as defined in claim 11, further comprising a carriage provided with cantilevered support arms adapted to extend through said frame for supporting said unit when said frame is displaced in said vertical plane.

13. The apparatus as defined in claim 12 wherein said support arms are disposed at a distance above an undercarriage of said carriage enabling passage of said pallet between said support arms and said undercarriage.

14. The apparatus defined in claim 13 wherein said table has a width less than a spacing between said support arms.

15. A method of packaging a stack of articles on a pallet forming a palletized unit, said palletized unit comprising a top formed by said stack, vertical sides formed by said stack, and a bottom adapted to support said unit, said pallet having skids along said bottom extending parallel to a first pair of said sides and being accessible to a fork for lifting and moving said unit at a second pair of said sides, said method comprising the steps of:

(a) passing said unit through a wrapping device having a horizontal axis and supporting a foil band source and wrapping said unit substantially vertically by winding a foil band from said source around said unit including underneath said pallet between at least a pair of said skids in a plurality of generally vertical turns from said top to said bottom and along one of said pairs of said sides, swinging said wrapping device into a position having a vertical axis perpendicular to said horizontal axis; and (b) lowering circumferentially around said stack from above said top of said stack said wrapping device and wrapping said unit substantially horizontally by winding said foil band from said source in a plurality of generally horizontal turns around said sides.

* * * * *